United States Patent [19]

van Ditshuizen et al.

[11] 4,162,556

[45] Jul. 31, 1979

[54] PROCESS AND APPARATUS FOR REMOVAL OF TRASH DEPOSITS ON OPEN-END SPINNING MACHINE

[75] Inventors: Henri van Ditshuizen; Fritz Schumann, both of Ingolstadt; Georg Goldammer, Gaimersheim; Richard Glaser, Ingolstadt, all of Fed. Rep. of Germany

[73] Assignee: Schubert & Salzer, Ingolstadt, Fed. Rep. of Germany

[21] Appl. No.: 821,359

[22] Filed: Aug. 3, 1977

[30] Foreign Application Priority Data

Aug. 3, 1976 [DE] Fed. Rep. of Germany ..... 2634770

[51] Int. Cl.[2] ..... B08B 7/00; B08B 5/04; A47L 5/38; D01H 11/00

[52] U.S. Cl. ..... 15/312 R; 134/6; 134/37; 57/301; 57/304

[58] Field of Search ..... 134/6, 37, 21; 15/306 R, 319, 301, 312 R; 57/56, 58.9

[56] References Cited

U.S. PATENT DOCUMENTS

| | | | |
|---|---|---|---|
| 2,585,776 | 2/1952 | Hérmánek | 15/312 R |
| 2,634,560 | 4/1953 | Ramm | 15/312 R |
| 3,153,803 | 10/1964 | Bahnson, Jr. | 57/56 |
| 3,687,730 | 8/1972 | Murphy | 15/312 R |
| 3,777,329 | 12/1973 | Lane | 57/58.89 |
| 3,839,764 | 10/1974 | Clayton | 57/56 |

*Primary Examiner*—S. Leon Bashore
*Assistant Examiner*—Chris Konkol
*Attorney, Agent, or Firm*—Bailey, Dority & Flint

[57] ABSTRACT

A method and apparatus for removing trash and the like from an elongated collection chamber provided on an open-end spinning apparatus. The trash, after separation from the fibrous material, is deposited in the collection chamber. A conveyor belt running through the collection chamber removes the large, coarse trash particles therefrom. A pneumatically intermittently operated collecting device removes the finer trash particles from the collection chamber without adversely affecting the separation operation wherein the trash is initially separated from the fibrous material. In one particular embodiment, a stripper cooperates with the conveyor belt that is used for removing the coarse trash particles for successively positioning a stream of air through the collecting chamber for removing the finer trash particles therefrom. A mechanical stripper is utilized with the stream of air for removing the fine trash particles from the walls of the chamber.

10 Claims, 5 Drawing Figures

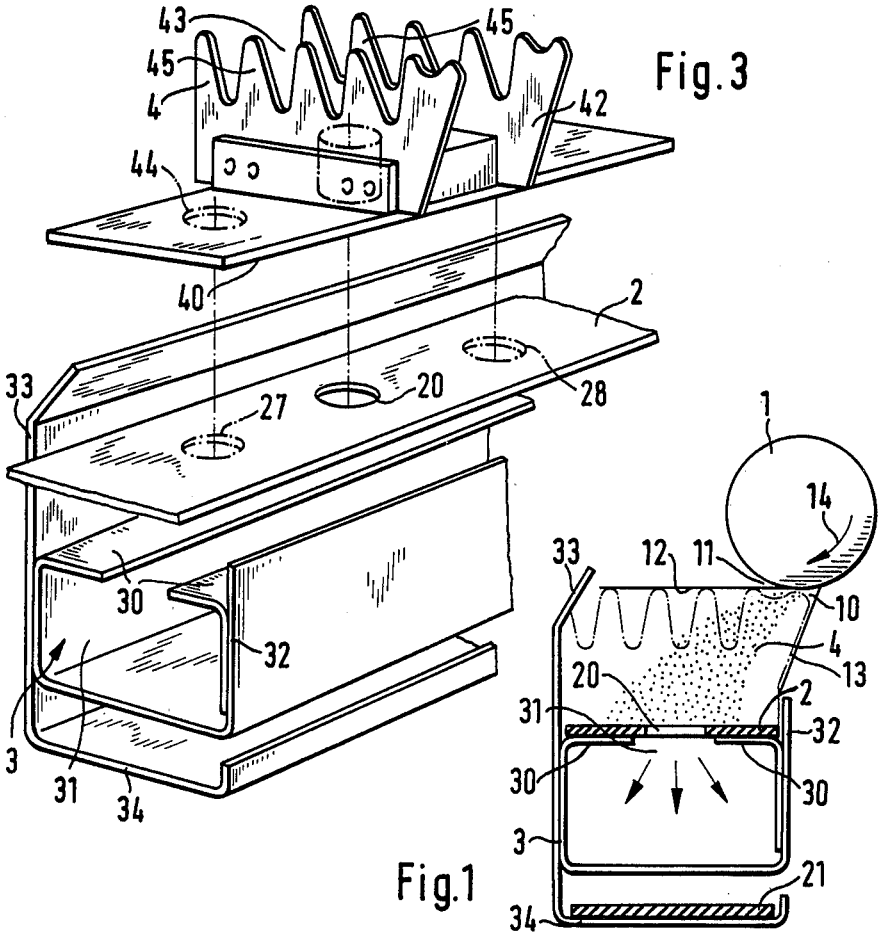
Fig.3
Fig.1
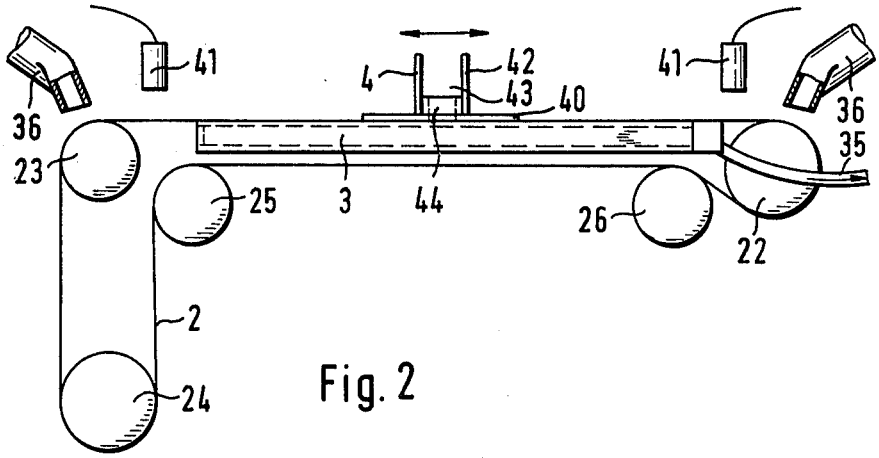
Fig. 2

PROCESS AND APPARATUS FOR REMOVAL OF TRASH DEPOSITS ON OPEN-END SPINNING MACHINE

BACKGROUND OF THE INVENTION

The present invention relates to a process for transporting away trash deposits on an open-end spinning apparatus, and also to an apparatus for carrying out this process.

It is known to continuously transport away the trash deposits at a spinning position of an open-end spinning apparatus (West German Auslegeschrift No. 1,922,078, column 6, lines 32 through 36). Here the removal of trash is effected with the aid of a trash removal belt. Apart from the coarse trash which falls onto this belt, finer dirt and fly are, however, deposited on the dirt separation apparatus and to a large extent remain adhering to the guide walls between the trash separation opening and the belt for transporting trash away and from time to time in the form of large flocks are sucked in by the spinning chamber. These flocks thus give rise to a disturbance of the spinning process which results in a thick place in the yarn and possibly in a yarn break.

It is also known to carry out the elimination of deposits discontinuously (West German Auslegeschrift No. 1,922,078, column 6, lines 40 through 54). Here a collecting chamber for the deposits is separated from time to time from the fiber/air stream by closing the trash deposition opening. There is indeed no effect of the pneumatic removal of the trash components on the spinning process, but there is temporarily no separation of trash.

In order not to have to interrupt the separation process, it is further known to control, by means of a control belt provided with an aperture, the connection between the collecting chambers and an air channel which is under reduced pressure, for intermittent carrying away of the separated trash components (West German Offenlegungsschrift No. 2,159,286). In order to prevent, in this apparatus, an accumulation of the fine trash and fly, a good seal of all the parts between the air channel and the trash separation apparatus is required, in order to ensure that the reduced pressure which is produced does actually fulfill its appointed task. For this, the reduced pressure must be very strong in order to prevent blockages of the connecting ducts. This is, however, disadvantageous for the fiber transport and, hence, for the quality of the yarn to be spun.

Because the maximum amount of trash is continuously removed, a rapid build-up of coarse trash in the collecting chamber is avoided. It is principally fine, difficulty controlable trash components, fiber fragments, and the fly that do not completely reach the trash removal belt and accumulate on the walls between the trash separation device and the trash removal belt. While, in the case of accumulation in collecting chambers and pneumatic removal of the trash components, intermittent emptying of the collecting chambers is possible only with the aid of a strong reduced pressure with considerable interference with the spinning process. No satisfactory removal of the trash components can be achieved by omission of the collecting chambers. With mechanical detachment and mechanical removal of the fine trash components, the trash components loosened from the walls arrive to a great extent back in the fiber/air stream and, hence, into the spinning chamber so that they exert an extremely disadvantageous influence on the spinning process.

SUMMARY OF THE INVENTION

In accordance with the present invention, in a mechanical device which continuously removes the trash, there is superimposed a pneumatic, discontinuous removal. By the mechanical, continuous removal of the trash components on the one hand, an excessive accumulation of the trash is avoided, while on the other hand, by the discontinuous removal of the fine trash components and of the fly, the trash components which are controlled with more difficulty are eliminated before detrimental accumulations arise. Since the fly can be eliminated by means of relatively weak air streams, the air stream for elimination of the fine trash components and the fly can be kept so weak that it has no deleterious effects on the spinning process.

For carrying out this process, there is used, according to the invention, a conveyor belt which covers an air channel that is under reduced pressure. The conveyor belt is movable along the air channel within a trash collection chamber and has at least one aperture therein. The air channel can be constructed in various ways. For example, the air channel can have a longitudinal slot which is covered by the conveyor belt. In this way, there results an air stream which travels along the collection chamber and acts discontinuously at the individual spinning positions. An air stream which has a precisely established direction results when an air channel, having one opening per spinning position, is utilized. The air streams are released when an opening in the conveyor belt overlaps the openings in the air channel. In this way, the coarse trash components fall onto the conveyor belt and are continuously carried away, the belt being conventionally cleaned of the trash components. The fine trash components, which are deposited on the guide walls of the collection chamber, are intermittently carried away by the air stream acting intermittently through the opening in the conveyor belt. The fine trash components and the fly are carried away from the individual spinning positions by this air stream so frequently that the accumulations of trash are still so small that they are not entrained in the fiber/air stream.

It is not absolutely necessary for the air stream to be sucked through the conveyor belt. According to a further embodiment of the invention, a discontinuously controlled suction nozzle opens between the trash separation opening and the conveyor belt.

In order to be able to keep the discontinuous air stream very weak, according to this further feature of the invention, a stripper that cooperates with the trash separation device is associated with the aperture in the conveyor belt or, respectively, with the suction nozzle.

It is indeed known to connect with the trash removal belt a stripper which cleans the trash separation device and strips off the light trash and fly adhering to the walls (West German Offenlegungsschrift No. 2,356,180). A part of the stripped-off trash falls onto a trash removal belt; on the other hand, another part is entrained in the fiber/air stream and arrives in the spinning chamber where a disturbance is caused. An advantage, according to the invention of a stripper, is attained for the first time in connection with the discontinuous removal of the loosened fine trash components and the fly, since in this way a disturbance of the spinning process is prevented.

In order not to have to maintain excessively tight manufacturing tolerances and, nevertheless, to ahieve an intensive detachment of the accumulated trash components from the walls, the stripper advantageously consists of elastic material. Preferably, two elastic strippers are provided pairwise, one behind the other, on the trash removal belt with the aperture arranged between them. The first stripper detaches the fine trash components and the fly from the walls, while the second stripper serves as an air guide and, together with the first stripper, forms a chamber so that the suction effect is confined to this space.

When discontinuous extraction by means of a suction nozzle is used, the latter is advantageously controlled by the stripper.

To simplify guiding of the belt, the trash removal belt is movable in either direction. In this case, an aperture is provided on each side of the stripper. In the case of strippers fitted pairwise, a further aperture can be provided in front of each stripper in the direction of transport, in addition to the aperture arranged between the strippers.

Control for the changing of the direction of transport can be effected in the various ways. Advantageously, the stripper is fitted by means of a holder to the changeably movable trash removal belt, and the holder is constructed as a changeover element for a control element which changes the direction of motion of the trash removal belt.

A solution of the basic cleaning problem in accordance with the invention is possible by separation and removal of both the coarse and finer trash components. Since the coarse trash components are continuously carried away, they cannot collect in the region of the spinning positions. Since they are mechanically carried away, no greatly reduced pressure is necessary. This reduced pressure can be kept small because in accordance with the invention, the removal of the fine trash and dust components takes place intermittently. The reduced pressure is, in this way, indeed sufficient to control the loosened trash components and the fly, but on the other hand, is too weak to have disadvantageous effects on the fiber/air stream and, hence, on the spinning process.

Accordingly, it is an important object of the present invention to provide a method and apparatus for removing both fine and coarse trash particles from a collection chamber associated with an open-end spinning machine without adversely affecting the spinning operation.

Another important object of the present invention is to provide a method and apparatus for continuously and mechanically removing coarse trash particles from a collection chamber while intermittently and penumatically removing the finer trash particles therefrom.

Still another important object of the present invention is to provide a simple and efficient apparatus for cleaning a trash collection chamber of both coarse and fine trash particles.

These and other objects and advantages of the invention will become apparent upon reference to the following specification, attendant claims, and drawings.

BRIEF DESCRIPTION OF THE DRAWINGS

FIG. 1 is a diagrammatic end view, partially in section, of an apparatus for removing trash particles from a collection chamber associated with an open-end spinning machine.

FIG. 2 is a side diagrammatic view of the apparatus constructed in accordance with the present invention for both mechanically and penumatically removing trash from a collection chamber.

FIG. 3 is an enlarged exploded perspective view of the trash removal device illustrated in FIGS. 1 and 2.

DESCRIPTION OF A PREFERRED EMBODIMENT

Figure 4:
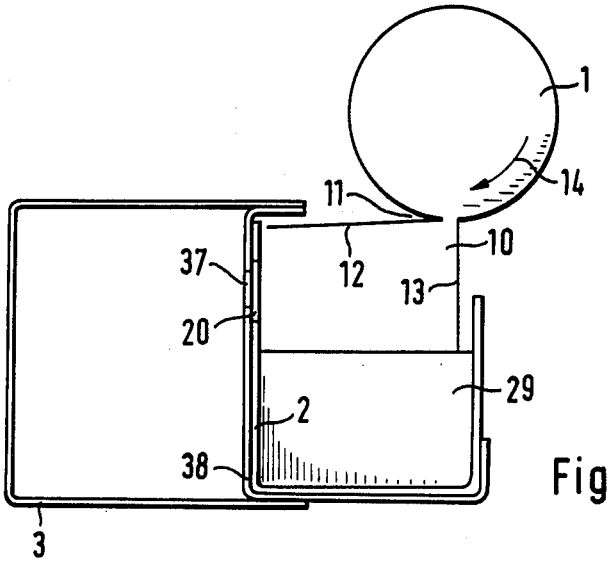
FIGS. 4 and 5 are sectional views illustrating two modified forms of the invention.

In FIG. 1, there is shown diagrammatically the releasing roll 1 of a sliver separating apparatus; the roll is mounted in a housing which is not shown. Only the trash separation device of the housing with a trash separation opening 10 is shown, the opening being bounded in the direction of transport 14 of the fibers by a separating edge 11. A baffle 12 adjoins the separating edge 11. The trash separation opening 10 is further bounded by a baffle 13.

Beneath the trash separation device 10 through 13 in the trash collection chamber is situated a conveyor belt 2 which is movable in the longitudinal direction of the open-end spinning machine. The trash removal belt 2 is moved along the upper side 30 of an air channel 3 which has a continuous slot 31 therein. With the air channel 3, there are connected lateral guides 32 and 33 for the conveyor belt, each more or less adapted to the flight path of the trash components in order to guide the dirt components onto the conveyor belt 2.

The conveyor belt 2 has an aperture 20 which produces the connection between the air channel 3 and the individual separation devices.

During operation, the fibers are transported in a fiber/air stream through the releasing roll 1 in the transport direction 14 towards the spinning chamber which is not shown. Coarse trash components, and also fine trash components and fly, are deposited through the trash separation opening 10. A particularly large quantity of fine trash deposits such as fiber fragments, fly and the like arise especially during the processing of low-value and/or heavily soiled material, such as, for example, many short staple kinds of cotton or noils.

The coarse trash components and also a part of the fine trash components and the fly arrive on the conveyor belt 2 as it moves along the collection chamber and are transported away by it. The rest of the fine trash components and the fly, however, lie on the baffles 12 and 13 and also on the lateral guides 32 and 33 where they accumulate with time. To prevent excessively large accumulations, which could be entrained by the air stream which is sucked in through the trash separation opening and fed to the fiber/air stream, the aperture 20 can be brought by the motion of the conveyor belt 2 successively to the individual spinning positions where the fine trash components and the fly, collected on the baffles 12 and 13 and on the guides 32 and 33 in the meantime, are sucked away by means of an air stream which is relatively weak and thus does not act disadvantageously in the trash separation opening 10. To support this action, a stripper 4 is associated, according to the invention, with the aperture 20 in the trash removal belt 2, and cooperates with the baffles 12 and 13 and the guides 32 and 33 of the trash separation device. This stripper is fastened to the conveyor belt 2 and is thus moved with the conveyor belt 2 along the air channel 3. It thus arrives simultaneously with the aperture 20 in the region of a spinning position where it mechanically detaches the fine trash components and the fly from the baffles 12 and 13 and the guides 32 and 33 upon which these trash deposits are sucked away through the opening 20 into the air channel 3.

The coarse trash components and a part of the fine trash components and the fly are thus continuously carried away mechanically by means of the trash conveyor belt 2 while the rest of the fine trash components and the fly, which temporarily accumulate on the baffles 12 and 13 and on the guides 32 and 33, are discontinuously removed pneumatically.

The guide 33 can merge into a belt guide 34 for the lower run 21 of the conveyor belt 2 which is guided beneath the air channel 3. The conveyor belt 2 is preferably endless and is guided and driven by means of rollers 22 through 26 (FIG. 2). The air channel is connected at one end by a dust 35 to a fan and suitable means for controlling the reduced pressure.

The apparatus, according to the invention, can be utilized with open-end spinning apparatus with one and more spinning positions. With spinning machines with more than one spinning position, the air channel 3 and/or the conveyor belt 2 extend over several or all spinning positions of a machine side. At one end or at each end of the conveyor belt path is provided a belt cleaning device, which can be constructed as a brush and/or as a suction nozzle.

To simply the guiding of the belt, in particular in the region of the rollers 22 through 26, the conveyor belt can preferably be driven in either direction so that the stripper 4 is movable out of the neighborhood of the one belt cleaning device 36 and as far as into the neighborhood of the other belt cleaning device 36. The changeover of the direction of motion of the conveyor belt can occur in various ways.

Suitably, however, the stripper 4 is fastened by means of a holder 40 to the reversibly movable conveyor belt 2, and the holder 40 is constructed as a switching element for a control element which changes the direction of motion of the conveyor belt 2. A switch 41 belongs to the control element and is operated mechanically, optically, magnetically or in any other suitable manner by the holder 40 in its end position upon which the reversal of motion is effected.

The stripper 4 can be constructed in various ways. In order to avoid tight tolerances, in particular with a large number of adjacent spinning positions, the stripper 4 preferably consists of elastic material, for example, of bristles or of rubber. In order to increase the flexibility, the free end of the stripper 4, consisting of rubber, is preferably divided into several finger-like partial strippers.

With only a single direction of motion of the trash removal belt 2, one stripper 4 is sufficient, together with one aperture 20 associated with the stripper 4 (FIG. 3). With reversible operation, apertures 27 and 28 are provided on each side of the stripper 4. The holder also has corresponding apertures 44.

According to a preferred embodiment of the invention, two elastic strippers 4 and 42 are provided pairwise, one behind the other, on the trash removal belt 2, with the aperture 20 provided between them. If desired, an aperture 27 or 28, respectively, can be provided for each direction of transport in front of each stripper 4 or 42, respectively.

With a direction of motion from right to left (relative to FIG. 3), the stripper 4 detaches the trash components adhering to the baffles 12 and 13 and also to the guides 32 and 33. Between the strippers 4 and 42, the detached trash components then arrive in the region of action of the aperture 2 so that they are sucked away into the air channel 3. The strippers 4 and 42, the baffles 12 and 13, and also the guides 32 and 33 form an almost closed chamber 43 (FIG. 2) so that a relatively weaker reduced pressure is sufficient to remove the detached trash components.

The present invention prevents with certainty the existence of deleterious accumulations of trash components on the baffles 12 and 13 and on the guides 32 and 33 and, hence, tends towards undisturbed spinning operation. This result is obtained by the superposition on the mechanical continuous removal of the trash deposits, a pneumatic discontinuous removal.

Figure 5:
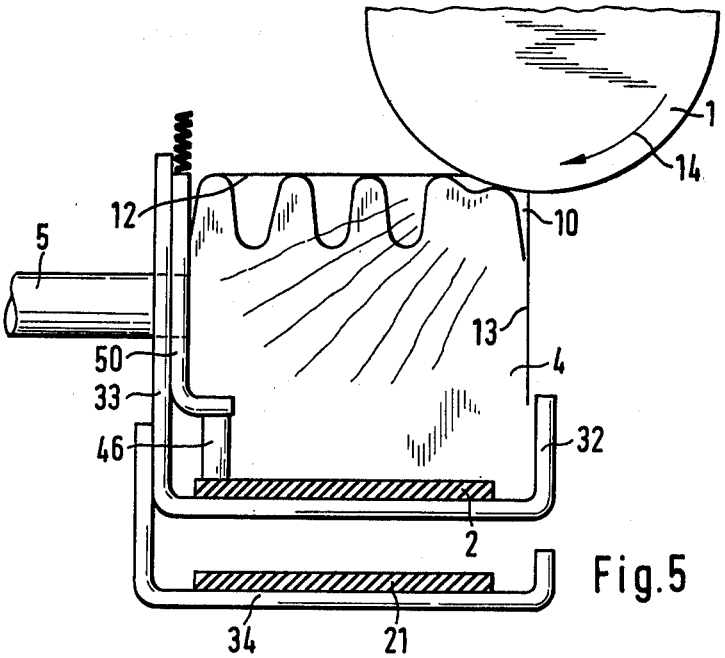

The apparatus, according to the invention, can be constructed in various ways. As shown in FIGS. 1 and 5, the stripper 4, or the stripper 4 and 42 can be omitted according to circumstances though, in this case, a somewhat stronger intermittent air stream is required to detach the trash components adhering to the baffles 12 and 13 and to the guides 32 and 33.

The air channel 3 also need not necessarily have a slot 31 (FIGS. 1 and 3). According to FIG. 4, there is provided in the air channel 3 for each spinning position an aperture 37 which can be covered by the conveyor belt 3 and released on being reached by the aperture 20. When several apertures 27, 20 and 28 are provided one behind the other in the conveyor belt 2, corresponding apertures for each spinning position are, of course, provided in the air channel 3. While the active air stream travels along the collection chamber in the case of the embodiment described above with a slot 31 in the air channel, covered by the conveyor belt 2, in the case of an embodiment with apertures 37 in the air channel 3 the air stream will always be effective only for a short time when the aperture 20 has reached the location adjacent to the spinning position. According to the constructional design of the open-end spinning apparatus, a better cleaning effect can be achieved by a concentric action.

It is also not necessary for the conveyor belt 2 to cover the upper side 30 of the air channel 3. As shown in FIG. 4, the conveyor belt 2 can also be guided alone a sidewall 38 of the air channel 3. In this case, the conveyor belt 2 has pockets 29 in which trash deposits are collected. The apertures 37 or the slot 31 in the air channel 3 are then arranged preferably above the pockets 29 and are closed and opened in the manner described by the conveyor belt 2 which is movable along the air channel 3.

According to another advantageous embodiment of the invention, there opens into the space between the trash separation opening 10 and the conveyor belt 2 a suction nozzle 5 which is discontinuously controlled in a suitable manner. A stripper 4 or a pair of strippers 4, 42 can also be provided, as desired, in an embodiment of this type.

It is also possible in such an embodiment to control the suction nozzle in dependence on the stripper 4. For example, a switch cam 46 is connected to the stripper 4 and can also be part of the holder 40 (FIGS. 2 and 3). This switch cam 46 actuates a displaceable or rotatable slider 50 which closes the suction nozzle 5 when in its initial position and, when displaced or pivoted by the switch cam 46, temporarily releases the suction nozzle 5. In this embodiment also, the trash deposits are continuously removed mechanically, and this mechanical, continuous removal has superposed on it a pneumatic, discontinuous removal so that fine trash cannot accumulate on the baffles 12 and 13. Naturally, the slider 50 can also be fitted on the outer side of the guide 33 or the correspondingly directed baffle 12 so that the freedom of motion of the slider 50 cannot be adversely affected by deposited trash components.

As shown by the foregoing description, the object of invention can be varied in many ways and in these the individual elements can be interchanged mutually and with equivalents. For example, in the embodiment shown in FIG. 5, each spinning position can be provided with its own stripper which is controlled independently of the conveyor belt 2 but, however, synchronously with the suction nozzle 5.

The removal apparatus according to the invention can be utilized with various trash separation apparatuses and is not limited to the embodiment of the trash separation apparatus selected as an example.

While a preferred embodiment of the invention has been described using specific terms, such description is for illustrative purposes only, and it is to be understood that changes and variations may be made without departing from the spirit or scope of the following claims.

What is claimed is:

1. An apparatus for removing trash containing both coarse and fine particles from an open-end spinning machine after said trash has been separated from fibrous material and deposited in said collection chamber, said collection chamber being positioned below a releasing roll forming part of said open-end spinning machine, said apparatus comprising:

a conveyor belt traveling through said collection chamber removing predominently the coarser particles of said trash;

means defining a trash separating opening providing communication between said releasing roll and said collection chamber through which said trash separated from said fibrous material passes into said collection chamber after separation, a fiber air stream flowing through said trash separating opening to said spinning machine, and means for successively moving a stream of air along the length of said chamber for withdrawing predominantly the smaller particles of said trash from said collection chamber without adversely affecting said spinning operation.

2. The apparatus as set forth in claim 1 wherein said means for successively moving a stream of air along the length of said chamber comprises:

an air channel carried in said collection chamber;

means for applying reduced pressure to said air channel;

means defining an aperature provided in said conveyor belt providing communication between said air channel and said chamber so that as said conveyor travels through said collection chamber an air stream flowing through said aperture is successively moved along the length of said chamber withdrawing the predominently smaller particles of said trash from said collection chamber.

3. The apparatus as set forth in claim 1 wherein said means for successively moving a stream of air along the length of said chamber comprises:

an intermittently controlled suction nozzle which is controlled in dependance of the movement of said conveyor belt along said collection chamber.

4. The apparatus as set forth in claim 1 further comprising:

a stripper means operably associated with said means for successively moving said stream of air for dislodging trash in said collection chamber for removal by said stream of air.

5. The apparatus as set forth in claim 4 further comprising:

said stripper means including a flexible member for dislodging said trash in said collection chamber.

6. The apparatus as set forth in claim 4 further comprising:

means for moving said stripper means with said stream of air along the length of said collection chamber;

said stripper including a pair of spaced flexible members, and said movable air stream being carried between said spaced flexible members.

7. The apparatus as set forth in claim 4 further comprising:

means for selectively moving said conveyor belt in opposite directions along the length of said collection chamber.

8. The apparatus set forth in claim 7 further comprising:

means for mounting said stripper means on said conveyor belt for movement therewith; and switching means for selectively reversing the direction of movement of said conveyor belt and said stripper so that said conveyor belt and said stripper move back and forth through said collection chamber.

9. An apparatus for removing trash and the like collected in a collection chamber on an open-end spinning machine after said trash has been separated from fibrous material being fed to a spinning chamber of said open-end spinning machine, said apparatus comprising:

means defining a trash separating opening providing communication between said releasing roll and said collection chamber through which said trash separated from said fibrous material passes into said collection chamber after separation, a fiber air stream flowing through said trash separating opening to said spinning machine, a conveyor belt traveling through said collection chamber receiving said trash being deposited therein and removing predominently the coarser particles of trash from said chamber;

an air channel carried adjacent said conveyor and extending along said collection chamber;

means for applying a reduced atmospheric pressure to said air channel; and means defining an opening carried in said conveyor belt providing communication between said air channel and said chamber through which a stream of air is sucked withdrawing predominantly the smaller particles of said trash from said collection chamber with out adversely affecting said spinning operation.

10. The apparatus as set forth in claim 9 further comprising:

an elongated slot carried in said air channel adjacent said opening in said conveyor belt;

means for moving said conveyor belt along said air channel so that said air stream flowing through said opening in said conveyor belt and said elongated slot travels with said conveyor belt along said collection chamber.

* * * * *